US006728978B1

(12) United States Patent
Nordin

(10) Patent No.: US 6,728,978 B1
(45) Date of Patent: May 4, 2004

(54) MULTIPLE HYGIENIC BED PAD WITH GLIDE FUNCTION

(75) Inventor: Inga Nordin, Ornsköldsvik (SE)

(73) Assignee: Jarven Plast & Smide AB, Ornskoldsvik (SE)

( * ) Notice: Subject to any disclaimer, the term of this patent is extended or adjusted under 35 U.S.C. 154(b) by 0 days.

(21) Appl. No.: 10/168,142

(22) PCT Filed: Sep. 6, 1999

(86) PCT No.: PCT/SE99/01549

§ 371 (c)(1),
(2), (4) Date: Jun. 17, 2002

(87) PCT Pub. No.: WO01/21047

PCT Pub. Date: Mar. 29, 2001

(51) Int. Cl.[7] ..... A61G 12/00; A61G 7/10

(52) U.S. Cl. ..... 5/81.1 HS; 5/81.1 T; 5/484; 5/925

(58) Field of Search ..... 5/484, 482, 81.1 T, 5/81.1 HS, 925, 496, 498

(56) References Cited

FOREIGN PATENT DOCUMENTS

| | | |
|---|---|---|
| GB | 2 189 993 | 11/1987 |
| GB | 2 202 738 | 10/1988 |
| WO | WO 96/06550 | 3/1996 |

*Primary Examiner*—Alexander Grosz
(74) *Attorney, Agent, or Firm*—Stites & Harbison PLLC; Douglas E. Jackson

(57) ABSTRACT

A re-usable hygienic bed product includes an absorbing object, a sliding material layer, a pulling sheet, and a moisture blocking layer. The absorbing product is a highly soaking, inert fibrous material which at the upper surface and the bottom surface is directly integral with a soft fabric. The absorbing object at two opposite edges is formed with projecting pulling sheet parts formed as wings extending transversally from the longitudinal edges at each side, which can be folded in under the mattress. The sliding material layer at the bottom surface is a semi-smooth or smooth material which facilitates a pulling of the entire hygienic bed product with the patient to any side of the bed. A moisture blocking layer is provided between the bottom surface and the sliding material layer, and is of a liquid tight material that prevents liquid from penetrating down to the sliding material layer.

14 Claims, 2 Drawing Sheets

MULTIPLE HYGIENIC BED PAD WITH GLIDE FUNCTION

BASIS OF THE INVENTION

The present invention relates to a hygienic bed product having a pulling sheet. The hygienic bed product is shaped or designed (a) to be lenient to persons lying in bed, (b) to protect the mattress and the bed against contamination and leakage of urine, of drainage and of other liquids, and (c) to be arranged for being reused after having been machine washed and drip-dried or tumble dried.

BACKGROUND OF THE INVENTION

It is natural and usual that patients lying in bed, both children and grown up people and elderly persons, give off liquids and contamination of various types. In order to prevent a person restricted to bed from feeling discomfort, and for protecting the bed and the mattress lying on the bed and the bed support, it has been usual to use some type of material which soaks up liquid and liquid type contamination, and which can be exchanged upon need. Such soaking materials can be in the form of an absorbing object of disposable type like soaking paper or any paper combination, cellulose tissue or a similar material, or it can be of reusable type, whereby, in the latter case, the absorbing object can be re-used.

A type of such a protective material having an absorbing object is shown in GB 2.202.738.

In order to make it possible to turn a person lying in bed, what has to be done frequently so as to prevent building up of pressure wounds, the patient has to be turned over sideways. This can often be a hard job, which also often can cause discomfort to the person lying in bed. For facilitating such turning over of a patient, it has been usual to use a "pulling sheet" placed under the patient and extending transversally to the longitudinal direction of the bed. When said pulling sheet is pulled sideways of the bed, using assisting personnel, usually also assisted by pushing personnel, the patient will roll sideways without being moved any noticeable distance in the transversal direction of the bed. In this way it is possible to turn the patient to any desired position, without exposing the patient to any noticeable discomfort, usually between a position with the patient lying on one side to lying on the back or to a position lying on the opposite patient side, or whichever other desired position.

Both the absorbing object and the pulling sheet have a relatively rough surface, and a displacement of the absorbing object and the pulling sheet may require relatively great forces. In order to reduce the work for the personnel in turning a patient in the above mentioned way, there has sometimes been used a so called "sliding sheet" between the patient and the absorbing object and/or the pulling sheet. Such a sliding sheet can be anchored to the bed, as by having the edges of the sliding sheet folded down and under the sides of the mattress. The sliding sheet generally is made of a slippery material like rayon, a smooth plastic material, etc. Since the patient easily can slide on the sliding sheet, it may happen that the patient un-intentionally slides on said sliding sheet, and this may result in accidents. In the worst case, the patient may even slide to one side and then fall down from the bed.

The publication WO 96/06550 discloses a bed protection device comprising an absorbing object which is integral with parts of the bed sheet. The absorbing object, at the top surface thereof, has a layer of a sliding material on which the patient is supposed to be able to move him/herself to the sides and up or down the bed. The parts of the sheet extending transversally outwards are to be folded in under the mattress, thereby securing the bed protection device against the mattress.

For preventing a patient from sliding out of the bed and eventually falling down to the floor and hurting him/herself when moving on the sliding material layer, said bed protection device is formed with hems at the upper surface of the bed protection device. The hems extend in the longitudinal direction of the bed a slight distance inside the edges of the mattress and the bed, so that the patient can feel, by manually sensing the said hems by his/her hands, where on the slide material layer he/she is placed. As long as the sliding material layer is dry, said known device may operate satisfactorily and the patient can in many cases move him/herself to the sides and turn him/herself thereby making sure he/she does not slide out of the bed, by sensing the position of said hems.

When a patient is to be turned he/she has to be lifted, and a pulling sheet is placed under the patient in a position between the patient and bed protection device. The patient is thereafter turned (rotated) as the pulling sheet is pulled transversally to the bed, whereby the patient is rolled while the pulling sheet slides on the upper sliding material layer of the bed protection device. During the turning operation, the bed protection device lies fixedly anchored against the mattress. After the patient has been turned, his/her position must be corrected, and thereafter the patient once again has to be lifted so that the pulling sheet can be removed. This operation is heavy and complicated.

It is also a known fact that a wet material results in a rough surface. Therefore, when the sliding material layer of the known device becomes wet depending on leakage from the patient, the sliding property of said layer is drastically reduced and it can be difficult or impossible for the patient to turn him/herself. Further, it can be very heavy for the assisting personnel to turn the patient using a pulling sheet. In the known device moisture can penetrate both through the sliding material layer to the absorbing object and up from the absorbing object to the sliding material layer.

SUMMARY OF THE INVENTION

The object of the present invention is to solve the problem of providing a hygienic bed product which overcomes the above mentioned disadvantages in the previously known devices. The present invention thus provides an integral product comprising a combination of an absorbing object, a sliding sheet and a pulling sheet, and which integral product is formed so that the patient can not un-intentionally slide off the bed. The sliding sheet is arranged at the bottom side of the product, well protected against penetration of moisture, so that the patient can be turned (rotated) without the need of applying a sliding sheet under the patient.

The main part of the combined apparatus is an "absorbing object" of a highly soaking, inert fibrous material of a type known per se. All around, or at least at its upper surface and its lower surface, the absorbing object is covered with a soft fabric, for instance a micro fiber material which easily lets through liquid in the direction downwards/inwards but prevents a penetration of liquid out through said fabric in the opposite direction. A well operating absorbing object may have a thickness of 2–6 mm, or preferably 3–4 mm; and should have a width which substantially corresponds to the width of the bed or the mattress thereof, for instance between 70–90 cm, or a width which is as much wider than the bed so that the projecting parts can be folded in under the mattress. The hygienic product/absorbing object can have a varying extension in the longitudinal direction of the bed, depending on the size and weight of the patient, for instance between 30–120 cm of preferably between 40–70 cm.

According to the invention, the bottom surface of the absorbing object is integral both with a moisture blocking layer which prevents further transfer of moisture, and with a sliding material layer, for instance a semi-slippery or a relatively slippery micro fiber. The combination product, comprising the absorbing object with the moisture blocking layer and the sliding material layer, should be formed so that it can be secured in the transversal direction by being folded in under the mattress so that the absorbing object with the sliding material layer can not unintentionally slide in the transversal direction of the bed. The moisture blocking layer and the sliding material layer can be sewed, welded, glued or secured in any other way to the bottom surface of the absorbing object.

The risk of accidents is thereby eliminated while at the same time the personnel can still turn the patient by making the patient roll on the absorbing object, as the entire combination unit, thanks to the sliding material layer at the bottom surface of the unit, can be pulled to the desired side position of the bed. Said sliding material layer always is dry and has a maintained sliding ability. Thereafter said combination unit can be secured as those parts of the absorbing object, or a part connected to said absorbing object, are folded in under the mattress.

For providing the "pulling sheet" in the combined apparatus according to the invention, the combined unit, comprising an absorbing object, a moisture blocking layer and a sliding material layer, can be made so much wider than the mattress for which it is intended to be used that parts of the unit can be folded in under the mattress. Alternatively, the unit can be formed with "wings" of a tearproof material, for instance a textile fabric of synthetic resin like polyester, which wings are sewed or otherwise attached to the side edges of the absorbing object. The wings are used as a pulling attachment means/pulling sheet when turning the patient and side displacement of the absorbing object with the moisture blocking layer and the sliding material layer on the mattress and/or the bed support.

It is also possible to form the absorbing object so wide that outer parts thereof can be folded in under the mattress and so that it can be used as a holding means when pulling the bed product at any side. In the latter case, the sliding material part can extend only over the part of the absorbing object which corresponds to the width of the bed; but it is, of course, also possible to provided a sliding material layer over the entire bottom surface of the absorbing object.

BRIEF DESCRIPTION OF THE DRAWINGS

Now the invention is to be described more in detail with reference to the accompanying drawings which show a couple of embodiments.

DETAILED DESCRIPTION OF THE INVENTION

Figure 1:
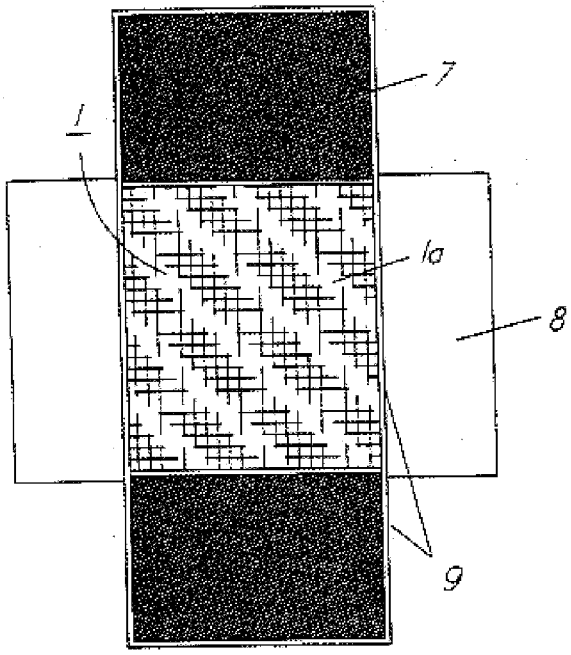
FIG. 1 shows a first embodiment of a bed product according to the invention seen from above and fully folded out transversal to the longitudinal direction of the bed.

The bed product according to FIGS. 1–4 generally comprises an absorbing object 1 formed with a base layer 2 of an inert, strongly soaking material. Preferably, base layer 2 is a fibrous material which, at the upper surface thereof, has a surface layer 3 of a soft material like a textile material which is solidly connected to the base layer 2 of the absorbing object 1. At the bottom surface of absorbing object 1 is a bottom layer 4 of the same type of material. At the underside of the bottom layer 4 there is a moisture blocking layer 5 of a liquid tight material like polyurethane, rubber, synthetic rubber etc., which has been welded, glued or otherwise fixed to the bottom layer 4. At the underside of the moisture blocking layer 5 there is a sliding layer 6 of a material of a relatively slippery type, which is adapted to be able to easily slide on the mattress 7. At the sides of the bed product there are outwardly projecting wings 8 adapted to be used as "pulling sheet wings". The wings 8 can be separate or can be attached to the absorbing object 1 and/or to the moisture blocking layer 5 and/or to the sliding material layer 6, or the wings may be a part of the combination bed unit projecting outside of the bed mattress 7.

In the drawings it is indicated that the bed product is formed to fit a bed 9 in the transversal direction thereof, and in the illustrated case the absorbing object 1 has a width which substantially coincides with, or is greater than the existing standard width of the bed 9 or the mattress 7 thereof. For instance, the absorbing object 1 can have a width of between 70 and 90 cm and a length—in longitudinal direction of the bed—which can be 40–100 cm, or more. The product unit is intended to be placed in such position in the bed 9 that the absorbing object 1 is located in a position of the mattress 7 corresponding to the trunk of a person lying in bed, but if desired it can be formed longer and can be laid at any place of the bed 9.

The absorbing object 1 can be made with a base layer 2 of any known material having good absorbing properties, for instance a fiber material. Base layer 2 is all around, or at least at the upper surface and the bottom surface thereof, formed with a lenient surface layer 3, 4 of a soft fibrous fabric, of a polyurethane film or of any other known material, in particular a material which allows liquid to pass into the base layer 2 of the absorbing object but prevents liquid from passing in the opposite direction. At the underside, between the bottom layer 4 and the sliding material layer 6, the absorbing object 1 is formed with a moisture blocking layer 5 of a liquid tight material for eliminating passage of liquid down to the mattress 7.

Figure 4:
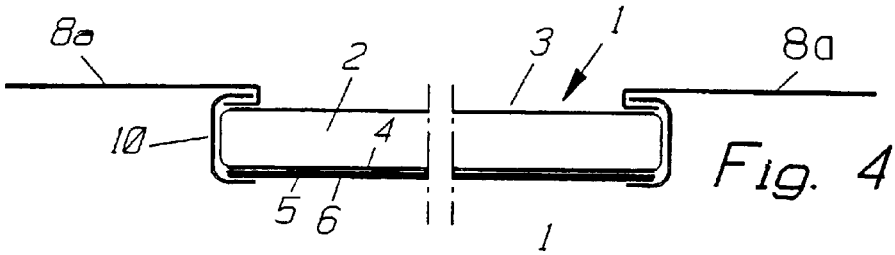
FIG. 4 is a partial cross section view along line IV—IV of FIG. 3.
Figure 5:
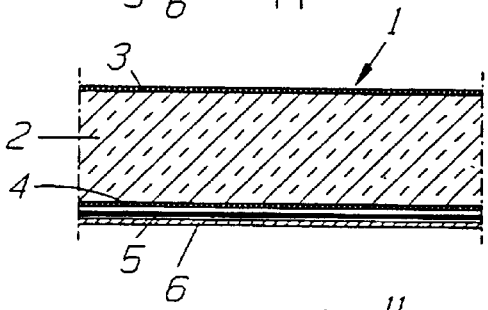
FIG. 5 is a cross section view in a further enlarged scale through a hygienic bed product according to the invention.

In FIG. 4 it is diagrammatically shown that the absorbing object 1 can be formed with an edge strip 10, and that also the moisture blocking layer 5 and the sliding material layer 6 can be secured to the absorbing object by means of said edge strip 10. In the case that the wings 8*a* are formed as separate units, said wings 8*a* also can be secured by being folded inwards round the edge strip 10 and can be sewed, glued or fixed in a corresponding way.

The sliding material layer 6 should be of a material having such a sliding property that the product, without obvious difficulty, can be pulled sideways on the mattress 7 with the patient lying on the product 1. The sliding property of the sliding layer 6, however, should not be so great that the absorbing object un-intentionally could slide on the mattress 7. A suitable material is a micro fiber material which is sewed or is welded or in a corresponding way is fixed to the bottom surface 4 and the moisture blocking layer 5 of the product 1. As indicated in FIG. 4, the sliding material layer 6 also can be secured to the absorbing object using the edge strip 10 which is sewed on the absorbing object 1.

Thus, an edge strip 10 can be sewed or welded round the entire absorbing object. As shown in FIG. 4, the wings 8a can be folded in at the upper side and can be sew connected between the absorbing object 1 and the edge strip 10. Also the wings can have a corresponding edge strip extending round the wings 8.

The wings 8 and 8*a*, respectively, should have such length in the direction transversal to the mattress 7 that they can be folded in under the mattress thereby fixing the bed product in relation to the bed support 9 with the mattress 7. The wings 8 and 8*a* can be a part of the combined hygienic bed product, or they can be separate and made of a tearproof strong material allowing a pulling with only a reasonable force of the patient together with the absorbing object to the side of the mattress. An example or material is a loose fabric of polyester or another non-soaking material.

An important feature of the invention is that the bed product, as the entire product, should be made of an inert material and should be re-usable, and that it should, as the entire product, be machine washable and be drip dried or dried in a tumble dryer.

Figure 2:
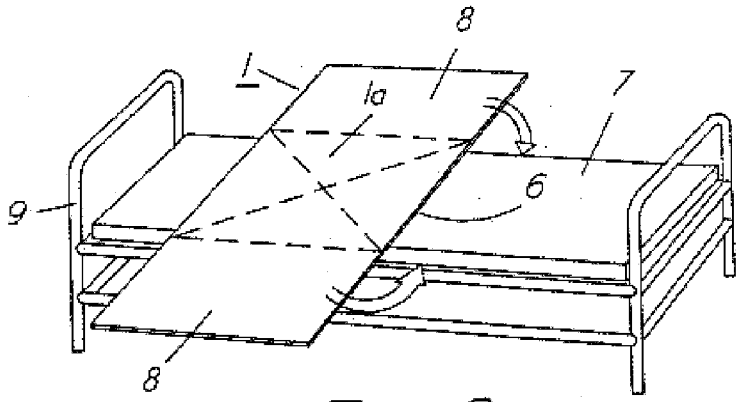
FIG. 2 shows the hygienic bed product according to the invention while being laid on a bed.
Figure 3:
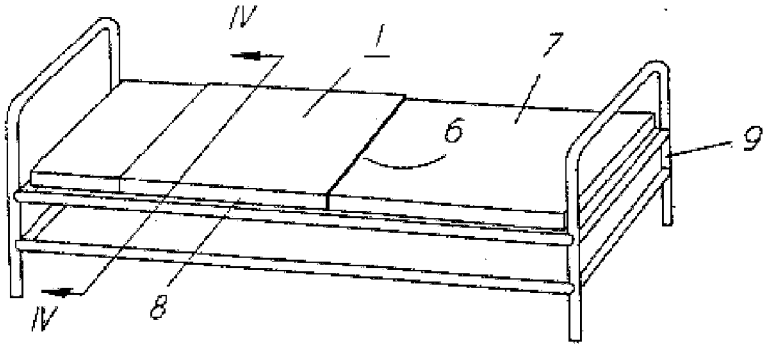
FIG. 3 shows the bed with the hygienic bed product secured to the bed.
Figure 6:
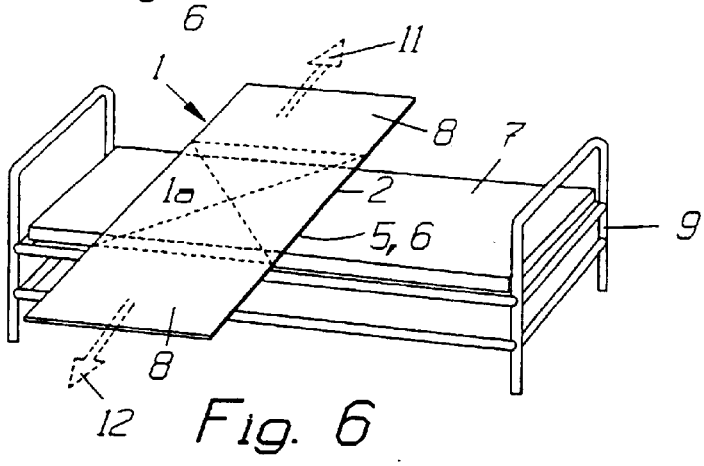
FIG. 6 diagrammatically illustrates how to turn a patient by means of the bed product according to the invention.
Figure 7:
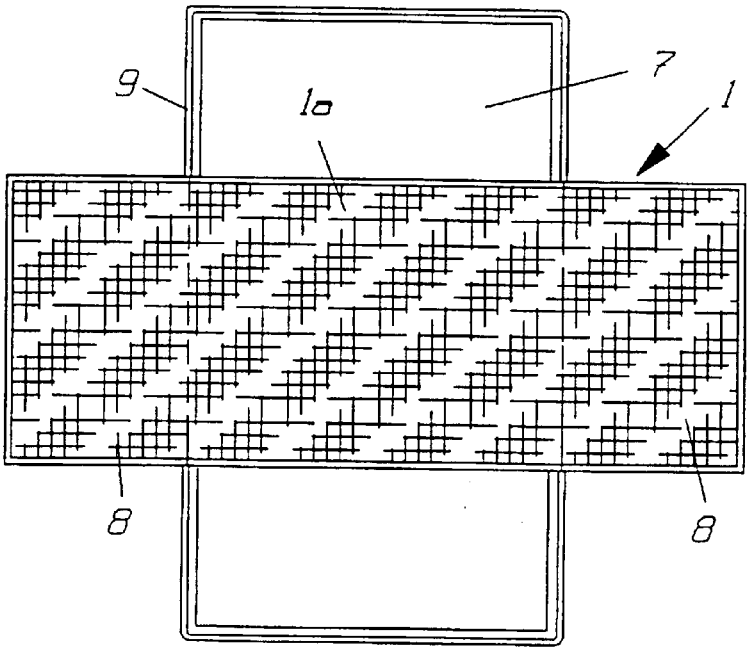
FIG. 7 shows, like in FIG. 1, an alternative embodiment of the hygienic bed product according to the invention seen from above.

In FIGS. 2 and 3 it is shown how the bed product is laid across the mattress 7 and how the wings 8 are folded in under the mattress 7 for securing the product in relation to the mattress. In FIG. 6 it is indicated how a patient can be turned, as the wings 8 are pulled out and the entire product is pulled in one direction or the other 11, 12 on the mattress 7 with the patient lying on the hygienic product 1. This is facilitated because the sliding material layer 6 slides rather easily on the mattress 7.

As mentioned above the absorbing object can be formed extended in the transversal direction so as to thereby form, with the intermediate part of thereof, an absorbing object 1*a* and with the sideways projecting outer parts thereof an equivalent to the pulling sheet part of the wings 8 of the previously described apparatus. The pulling sheet parts or the wings 8, 8*a* can, in the illustrated embodiments, be folded in under mattress 7 and can secure the entire combined hygienic bed product against same. An object having an absorbing product extending over the entire length of the product is, indeed, slightly more expensive to manufacture than an object having separate wings 8*a* but is, on the other hand, more simple to use and to be placed in the bed and is further advantageous in that it can be used for different wide beds.

What is claimed is:

1. An inert, re-usable hygienic bed product which (a) is lenient to persons lying in bed, (b) is designed for protecting a mattress and a bed against leakage, (c) facilitates the caring persons lying in bed, and (d) is easily washed and drip dried or tumble dried, said bed product comprising:

an absorbing object made of a highly soaking, inert fibrous material, and having an upper surface, a bottom surface, and two opposite sides;

a soft fabric covering at least the upper and bottom surfaces of said absorbing object;

respective projecting pulling sheet parts formed as wings extending out respectively from the two opposite sides of the absorbing object, said wings being used as a pulling sheet for turning a patient and being adapted to thereafter be folded in under the mattress of the bed;

a sliding material layer at the bottom surface of the absorbing object which facilitates a pulling movement of the entire hygienic bed product with the patient lying on the bed or lying on the mattress thereof; and a moisture blocking layer arranged between the bottom surface of the absorbing object and the sliding material layer, the moisture blocking layer being made of a liquid tight material preventing liquid from penetrating to the sliding material layer.

2. A hygienic bed product according to claim 1, wherein the absorbing object includes a base layer of a highly soaking, inert fibrous material which is directly integral with the soft fabric, and wherein the soft fabric easily lets through liquid in a direction towards the base layer but prevents a penetration liquid in the opposite direction.

3. A hygienic bed product according to claim 2, wherein said soft fabric is located all around said absorbing object.

4. A hygienic bed product according to claim 2, wherein the soft fabric is one of a micro fibrous material, a plastic film, or a similar material.

5. A hygienic bed product according to claim 1, wherein the sliding material layer at the bottom surface of the absorbing object is sewed or welded to the bottom surface of the absorbing object and comprises a layer of a material having at least moderate sliding properties.

6. A hygienic bed product according to claim 5, wherein said sliding material layer is a semi smooth or a relatively smooth micro fiber.

7. A hygienic bed product according to claim 1, wherein the wings are made of a tear-proof, inert material which are respectively secured to respective opposite sides of the absorbing object.

8. A hygienic bed product according to claim 1, wherein the absorbing object is substantially wider than the bed, and wherein outer side parts of the absorbing object form the pulling sheet parts which extend from said absorbing object so as to be folded in under the mattress of the bed.

9. A hygienic bed product according to claim 1, further including an edge strip which laterally encloses the absorbing object, the sliding material layer, and the pulling sheet parts.

10. A hygienic bed product according to claim 9, wherein the pulling sheet parts are folded in under the edge strip and are sew connected to the absorbing object together with the edge strip at the upper surface of the absorbing object.

11. A hygienic bed product according to claim 1, wherein the absorbing object has a thickness of 2–6 mm, and wherein the sliding layer has a length of about 70 cm transversal to a direction of the bed.

12. A hygienic bed product according to claim 11, wherein the thickness is 3–4 mm.

13. A hygienic bed product according to claim 1, wherein the absorbing object has an extension of 30–120 cm, as seen in the longitudinal direction of the bed.

14. A hygienic bed product according to claim 13, wherein the extension is 40–70 cm.

* * * * *